US006774760B2

(12) United States Patent
Kalra et al.

(10) Patent No.: US 6,774,760 B2
(45) Date of Patent: Aug. 10, 2004

(54) FUSE ELEMENT POSITIONING BODY

(75) Inventors: Varinder K. Kalra, Chesterfield, MO (US); Keith A. Spalding, Fenton, MO (US); Conrad M. Reeder, Wildwood, MO (US)

(73) Assignee: Cooper Technologies Company, Houston, TX (US)

( * ) Notice: Subject to any disclaimer, the term of this patent is extended or adjusted under 35 U.S.C. 154(b) by 5 days.

(21) Appl. No.: 09/874,453

(22) Filed: Jun. 5, 2001

(65) Prior Publication Data

US 2002/0190837 A1 Dec. 19, 2002

(51) Int. Cl.[7] ..... H01H 85/175; H01H 85/165

(52) U.S. Cl. ..... 337/263; 337/262; 337/246; 29/623

(58) Field of Search ..... 337/158, 186, 337/187, 227, 228, 246, 248, 262, 263; 29/623

(56) References Cited

U.S. PATENT DOCUMENTS

| | | | | | |
|---|---|---|---|---|---|
| 1,466,423 | A | * | 8/1923 | Conrad | 337/240 |
| 3,575,682 | A | * | 4/1971 | Fahnoe | 337/282 |
| 3,629,768 | A | * | 12/1971 | Scherer | 337/275 |
| 3,699,490 | A | * | 10/1972 | Macemon | 156/172 |
| 3,735,315 | A | * | 5/1973 | Swarbrick et al. | 337/231 |
| 3,878,497 | A | | 4/1975 | Spangler | |
| 4,193,053 | A | * | 3/1980 | Biller et al. | 337/273 |
| 4,229,723 | A | * | 10/1980 | Tobin | 218/146 |
| 4,253,081 | A | * | 2/1981 | Tobin | 218/57 |
| 4,467,308 | A | * | 8/1984 | Arikawa et al. | 337/231 |
| 4,540,969 | A | * | 9/1985 | Sugar | 337/228 |
| 4,952,900 | A | * | 8/1990 | Cameron et al. | 337/217 |
| 5,214,406 | A | * | 5/1993 | Reese et al. | 337/231 |
| 5,739,740 | A | | 4/1998 | Stärk et al. | |
| 6,147,585 | A | * | 11/2000 | Kalra et al. | 29/623 |

FOREIGN PATENT DOCUMENTS

| | | | | |
|---|---|---|---|---|
| EP | 423897 | A1 * | 4/1991 | H01H/85/157 |
| JP | 138528 | | 5/1996 | |
| JP | 08222117 | | 8/1996 | |
| JP | 297686 | | 10/2001 | |

OTHER PUBLICATIONS

"Academic Press Dictionary of Science and Technology", Edited by Christopher Morris, Academic Press, p. 292.*
Search Report Under Section 17, Oct. 18, 2002.

* cited by examiner

*Primary Examiner*—Anatoly Vortman
(74) *Attorney, Agent, or Firm*—Armstrong Teasdale LLP

(57) ABSTRACT

In an exemplary embodiment, a fuse body includes a first end, a second end and a bore extending therethrough for receiving a fuse element assembly. The bore includes a clearing portion having a first cross sectional area and a positioning portion having a second cross sectional area. The first cross sectional area is larger than the second cross sectional area. The positioning portion provides a receptacle for receiving the fuse element assembly and ensuring that the fuse element is substantially centered within the clearance portion.

10 Claims, 2 Drawing Sheets

FUSE ELEMENT POSITIONING BODY

BACKGROUND OF THE INVENTION

This invention relates generally to electrical fuses, and, more particularly to fuses including enclosed fuse elements for opening electrical circuits during low overcurrent conditions.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals so that when electrical current through the fuse exceeds a predetermined limit, the fusible elements melt and open one or more circuits through the fuses to prevent electrical component damage.

A fuse element or assembly is enclosed in a nonconductive housing or body extending between the terminals. Typically, the fuse body includes a substantially uniform bore of generally constant cross sectional area therethrough. When the fuse element or assembly is inserted into the bore of the fuse body during assembly of the fuse, the fuse element may be non-centered with respect to the bore, or in other words too close to a portion of the fuse body. As current flows through the fuse element or assembly, the portion of the fuse body closest to the fuse element may draw heat from the fuse element that would otherwise contribute to opening of the fuse element. While this effect is negligible at high overcurrent values that generate large amounts of heat, heat loss to the fuse body can significantly impair operational reliability of fuse elements designed to open in relatively low overcurrent conditions that generate relatively small amounts of heat. This is particularly the case when the warmest portions of the fuse element touch a portion of the fuse body after assembly of the fuse.

Some conventional fuses therefore employ mechanisms to properly position the fuse element within a fuse body. For example, in one type of fuse, washers are utilized at each end of a fuse body to prevent a fuse element from touching sidewalls of the fuse body. In another type of fuse, the fuse element is inserted through an opening in a fuse termination and soldered to the termination to correctly position the fuse element within a fuse body when the termination is attached to the body. In still another type of known fuse, a bridge is employed within a fuse body to support a fuse element and to prevent the fuse element from contacting the interior of the fuse body While the above-described constructions have achieved success in isolating a fuse element from an interior of a fuse body, proper positioning of the fuse element within the body is achieved only with additional components that require additional assembly steps and material costs.

BRIEF SUMMARY OF THE INVENTION

In an exemplary embodiment, a fuse body includes a first end, a second end and a bore extending therethrough for receiving a fuse element or fuse element assembly. The bore includes a clearing portion having a first cross sectional area and a positioning portion having a second cross sectional area. The first cross sectional area is larger than the second cross sectional area.

More specifically, in one embodiment, a substantially circular bore extends through a substantially rectangular fuse body. The clearing portion extends for a first length, and the positioning portion extends for a second length that is less than the first length. A guide portion is located intermediate the clearing portion and the positioning portion, and includes a cross sectional area intermediate, or in between, the cross sectional areas of the positioning portion and the clearing portion to facilitate insertion of the fuse element assembly into the fuse body bore.

The positioning portion provides a receptacle for receiving the fuse element assembly and ensuring that the fuse element is substantially centered within the clearance portion, thereby creating a clearance between the warmest portions of the fuse element assembly and the fuse body that may impair operation of the fuse element assembly in an overcurrent condition. As such, the warmest portions of the fuse element are prevented from touching the interior of fuse body bore. Reliable fuse operation is therefore ensured even for very low fault currents.

DETAILED DESCRIPTION OF THE INVENTION

Figure 1:
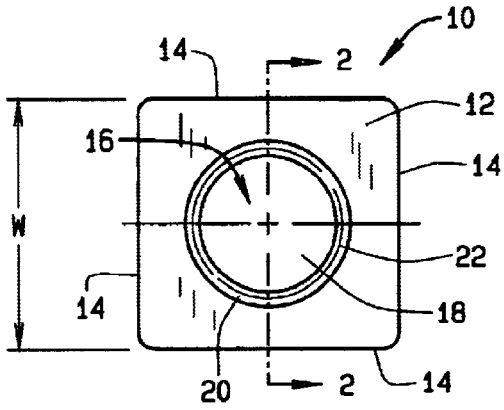
FIG. 1 is a side elevational view of a fuse body.

FIG. 1 is a side elevational view of one end of a fuse body 10 that facilitates positioning of a fuse element assembly (not shown in FIG. 1) therein to ensure reliable fuse operation in low overcurrent applications by preventing the warmest portions of the fuse element from touching the interior of fuse body 10. Thus, body 10 is prevented from drawing heat from the fuse element and impairing fuse operation at low overcurrent levels that generate relatively low amounts of heat in the fuse element.

Fuse body is fabricated from a known nonconductive material and includes a generally square end surface 12 and side surfaces 14 extending generally perpendicular to end surface 12 to form a rectangular fuse body 10. A substantially circular bore 16 extends through body 10 and is substantially centered between sides 14. As explained more fully below, bore 16 includes a first or positioning portion 18 having a first diameter, a second or clearing portion 20 having a second diameter that is larger than the diameter of positioning portion 18, and a third or guide portion 22 located intermediate positioning portion 18 and clearing portion 20 and having a variable diameter transitioning between the diameters of bore positioning portion 18 and bore clearance portion 20. Bore guide portion 22 facilitates insertion of the fuse element into bore positioning portion 18 wherein the fuse element is maintained in an approximately centered position in spaced relationship to interior walls of bore clearance portion 20. As such, the warmest portions of the fuse element are prevented from touching the interior of fuse body bore 16. Reliable fuse operation is therefore ensured even for very low fault currents.

In one embodiment, fuse body 10 is approximately 0.1 inches (2.54 mm) square, i.e., each side 14 of body 10 has a width W of approximately 0.1 inches. Dimensions of bore positioning portion 18 and clearance portion 20 are selected to accommodate a desired fuse link or fuse element, explained further below. It is recognized, however, that the benefits of the invention could be achieved in alternative embodiments using other configurations of fuse body 10, such as, for example, by using a cylindrical or tubular body in lieu of the illustrated rectangular fuse body 10 including square end surface 12. Still further, fuse element positioning within fuse body 10 could be achieved in an alternative embodiment with a non-circular bore through fuse body 10 within the scope of the present invention.

In a further exemplary embodiment, fuse body 10 is fabricated from an engineered ceramic material such as, for example, AZ-25 (Alumina Zirconia) composite material commercially available from CoorsTek, Inc. of Golden, Colo. and having the following exemplary properties

| | |
|---|---|
| Density | 3.82 gms/cc |
| Flexural Strength (MOR) (20° C.) | 172 MPa |
| Compressive Strength (20° C.) | 2310 MPa |
| Hardness | 75 Gpa |
| Thermal Conductivity (20° C.) | 13.0 W/m K |
| Maximum Use Temperature | 1400° C. |
| Dielectric Constant (1 Mhz 25° C.) | 9.8 |

As such, fuse body 10 may be particularly suited for telecommunications applications, and may be used with an appropriate fuse element to interrupt, for example, a 60 A current at 600 Volts AC, despite a small package size of the fuse body, e.g., 10 mm×2.77 mm by 2.77 mm in one embodiment. Thus, not only may reliable operation of the fuse element be ensured at lower overcurrent levels through proper positioning of the fuse element within a compact fuse body 10, but fuse body 10 may safely withstand fuse operation at higher current levels as well. It is contemplated that other known materials having similar properties could be employed in alternative embodiments in lieu of AZ-25 composite material to provide adequate fuse performance for a given application. For example, in still other alternative embodiments, other known non-conductive or dielectric materials are employed to fabricate fuse body 10, such as steatite, alumina, corderite, and thermoset plastic and thermoplastic materials.

Material selection for fabrication of fuse body 10 is dependant upon a fuse rating of the fuse element used in conjunction with fuse body 10 for a selected fuse application. Fabrication materials for fuse body 10 should withstand operating temperatures and environments without fracturing or otherwise failing.

Figure 2:
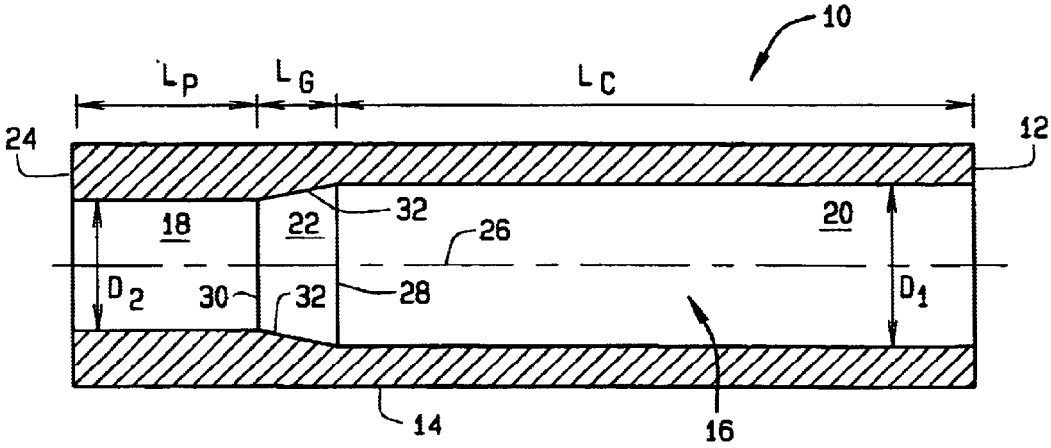
FIG. 2 is a cross sectional view of the fuse body shown in FIG. 1 along line 2—2.

FIG. 2 is a cross sectional view of fuse body 10 illustrating bore 16 extending from first end surface 12 to a second end surface 24 located on respective opposite ends of fuse body 10. Bore 16 extends longitudinally through fuse body 10 about a longitudinal axis 26 that is approximately centered between and parallel to fuse body sides 14.

Bore clearing portion 20 extends from first end surface 12 to a first end 28 of bore guide portion 22, and bore positioning portion 18 extends from a second end 30 of bore guide portion 22 to second end surface 24 of fuse body 10. Each of bore portions 18, 20, 22 are in flow communication with one another and therefore form a continuously extending bore 16 through fuse body 10. A diameter $D_1$ of bore clearing portion 20 is larger than a diameter $D_2$ of bore positioning portion 18, and bore guide portion 22 is conical in shape having diameter $D_1$ at first end 28 and diameter $D_2$ at second end 30. In other words, bore guide portion 22 includes an inwardly sloping interior surface 32, i.e., sloping toward bore longitudinal axis 26 from first end 28 to second end 30, between bore clearing portion 20 and bore positioning portion 18. Thus, a cross sectional area of bore guide portion 22 decreases from first end 28 coincident with bore clearing portion 20 to second end 30 coincident with bore positioning portion 18. In contrast, bore clearing portion 20 and bore positioning portion 18 each include substantially constant cross sectional areas, or in the illustrated embodiment, substantially constant diameters.

In addition, bore clearing portion 20 extends for a first length $L_C$, bore positioning portion 18 extends for a second length $L_P$ that is less than $L_C$, and bore guide portion 22 extends for a length $L_G$ that is less than $L_P$. Thus, bore guide portion 22 is off-centered with respect to fuse body end surfaces 12 and 24. Bore clearing portion 20 has a thickness T sufficient to keep fuse body from fracturing when a selected fuse element (not shown in FIG. 2) opens therein.

In one exemplary embodiment, exemplary nominal dimensions for fuse body 10 are as follows:

| | |
|---|---|
| $D_1$ | 0.063 in (1.60 mm) |
| $D_2$ | 0.052 in (1.32 mm) |
| $L_C$ | 0.248 in (6.30 mm) |
| $L_P$ | 0.070 in (1.78 mm) |
| $L_G$ | 0.030 in (0.76 mm) |
| T | 0.016 in (0.41 mm) |

While specific exemplary dimensions are provided for one embodiment, it is contemplated that the dimensions of fuse body 10 may be varied in alternative embodiments within the scope of the present invention.

Diameter $D_1$ is selected to be larger than an outer dimension of a fuse element assembly for use with fuse body 10 to provide an adequate clearance for the fuse element assembly to facilitate insertion of the fuse element assembly into fuse body bore clearing portion 20 with relative ease. Diameter $D_2$ is selected to be substantially coextensive with, i.e., about the same as, or slightly larger than, the outer dimension of the fuse element assembly, thereby substantially preventing lateral displacement, i.e., movement transverse to bore longitudinal axis 26, of the fuse element assembly when the fuse element assembly is inserted into positioning portion 18. When a fuse element (not shown in FIG. 2) is inserted into fuse body bore 16 from first end surface 12, the fuse element contacts inner surface 32 of bore guide portion 22 and funnels or directs the fuse element into bore positioning portion 18. Positioning portion 18 forms a receptacle for the fuse element assembly to ensure proper positioning of the fuse element assembly within fuse body 10. It is understood, however, that the fuse element may be inserted from either end surface 12, 24 while accomplishing proper positioning of the fuse element within fuse body bore 16.

Figure 3:
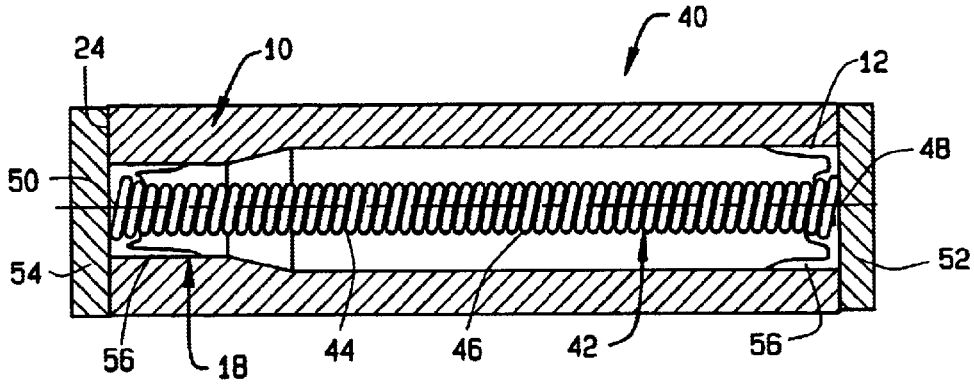
FIG. 3 is a cross sectional schematic view of a fuse employing the fuse body shown in FIG. 1 and FIG. 2.

FIG. 3 is a cross sectional schematic view of an exemplary fuse 40 including fuse body 10 (shown in FIGS. 1 and 2) and a fuse element assembly 42 located in fuse body bore 16.

In one embodiment, fuse element assembly 42 includes a generally cylindrical nonconductive or insulative former or core 44 and a helical fuse element 46 wound about core 44 between opposite ends 48 and 50 of core 44. In an illustrative embodiment, core 44 is fabricated from ceramic yarn and fuse element 46 is fabricated from a known conductive material into a wire that is properly dimensioned so that fuse element melts, disintegrates, separates, or otherwise opens to break an electric circuit through fuse 40 upon an occurrence of specified overcurrent values. In an alternative embodiment, other known nonconductive materials, such as fiberglass, are employed for fabricating core 44, and other known fuse link constructions may be employed in addition to or in lieu of the above-described wire fuse element 46.

Conductive end caps 52, 54 are secured to opposite ends 48, 50 of fuse element assembly 42 and solder 56 establishes electrical connection between fuse element assembly 42 and end caps 52, 54. In an illustrative embodiment, end caps 52, 54 are thin flat plates secured to fuse body end surface 12 and 24 for surface mounting of fuse 40. In alternative embodiments, end caps 52, 54 include wire leads, blade type terminal connectors, and the like for non-surface mount installation.

When end-caps 52, 54 are connected to an energized electrical circuit, an electrical circuit is established through fuse 40, and more specifically through fuse element 46 extending between fuse body ends 12, 24 and end caps 52, 54. Current passing through fuse element 46 heats fuse element 46, and when the current reaches a predetermined magnitude determined by fuse element characteristics, sufficient heat is generated in fuse element 46 to melt, disintegrate or otherwise cause fuse element 46 to separate and break or open the electrical circuit through fuse 40, typically at a location near the center of fusible element 46 where the most heat is generated. Therefore, electrical circuits coupled to fuse 40 may be isolated and protected from otherwise damaging fault currents.

The reduced diameter of fuse body positioning portion 18 maintains an adequate clearance between fuse element assembly 42 and an interior surface of fuse body clearing portion 20, even as fuse element assemblies are inserted randomly into fuse body 10 from either of fuse body ends 12, 24. Because of the reduced diameter of fuse body positioning portion 18, fuse element assembly may not be positioned substantially parallel to and adjacent an interior surface of fuse body 10 when fuse element assembly 42 is fully inserted into fuse body 10., and a minimum separation of fuse element 46 near the center of core 44 and the interior surface of fuse body 10 is ensured. As such, the warmest portions of fuse element 46 located in the central portion of fuse element 46 near the center of core 44 are prevented from touching the interior of fuse body 10, and fuse element 46 may reliably operate even at relatively low fault currents.

It is recognized that the minimum separation of the warmest portion of fuse element 46 and the interior surface of fuse body 10 may be varied by adjusting one or more of the outer diameter of fuse element assembly 42, the inner diameter of fuse body positioning portion 18, or the inner diameter of bore 16. In alternative embodiments employing a non-cylindrical fuse element assembly and non-cylindrical bores through fuse body 10, relative outer dimensions of the fuse element assembly and inner dimensions of fuse body 10 could likewise be adjusted to ensure proper separation of the fuse element assembly and the inner surfaces of the fuse body at specified locations. Still further, relative lengths of fuse body positioning portion 18, guide portion 22 and clearing portion 20 could be employed to adjust a minimum separation of fuse element assembly 42 and the inner surface of fuse body 10 as the fuse element assemblies are randomly inserted into fuse body 10 during manufacturing operations.

It is further contemplated that the benefits of the present invention may be accomplished using alternative fuse element assemblies known in the art. For example, more than one fuse element or fuse link could be employed between end caps 52, 54. In addition, fuse links or elements with one or more narrowed portions or weak spots may be employed in lieu of the wire fuse element 46 illustrated and described above. Still further, one or more fuse elements or links may be linearly extended between end caps 52, 54 rather than the illustrated helically extending fuse element 46, and in another embodiment a linearly extending fuse element may be employed in parallel with a spirally wound fuse element, as is known in the art, to increase a capacity of the fuse element assembly.

While the invention has been described in terms of various specific embodiments, those skilled in the art will recognize that the invention can be practiced with modification within the spirit and scope of the claims.

What is claimed is:

1. A fuse comprising:

a fuse body comprising a first end, a second end and a bore extending therethrough, said bore comprising a clearing portion having a first cross sectional area and a positioning portion having a second cross sectional area, said first cross sectional area different than said second cross sectional area;

a fuse element assembly within said bore and extending substantially from said first end to said second end of said bore, said fuse element assembly comprising an outer dimension substantially coextensive with said second cross sectional area, a portion of said fuse element assembly substantially centered within said first cross sectional area, thereby ensuring a clearance between a fuse element and an interior surface of said fuse body within said clearing portion;

a first end cap secured to said first end of said fuse body and electrically connected to said fuse element assembly; and a second end cap secured to said second end of said fuse body and electrically connected to said fuse element assembly.

2. A fuse in accordance with claim 1 wherein said fuse body is fabricated from Alumina Zirconia.

3. A fuse in accordance with claim 1 wherein said fuse body is substantially rectangular.

4. A fuse in accordance with claim 1 wherein said bore is substantially circular.

5. A fuse in accordance with claim 1, said fuse body further comprising a guide portion intermediate said positioning portion and said clearing portion.

6. A fuse in accordance with claim 1 wherein said fuse element assembly comprises at least one fuse element comprising a first end, a second end, and a central portion, said fuse element assembly situated in said bore so that said central portion of said at least one fuse element is disposed within said clearing portion.

7. A fuse in accordance with claim 1 wherein said clearing portion extends for a first length, said positioning portion extending for a second length, said first length greater than said second length.

8. A fuse in accordance with claim 7 said fuse body further comprising a guide portion intermediate said positioning portion and said clearing portion, wherein said guide portion extends for a third length, said third length less than said first length.

9. A fuse in accordance with claim 8 wherein said third length is less than said second length.

10. A fuse in accordance with claim 1 wherein said end caps comprise substantially flat plates for surface mounting of said fuse.

* * * * *